US007273528B2

(12) United States Patent
Kubota

(10) Patent No.: US 7,273,528 B2
(45) Date of Patent: Sep. 25, 2007

(54) DEVICE FOR ASSISTING THE APPLICATION OF ADHESIVE TAPE

(75) Inventor: Masayuki Kubota, Kanagawa (JP)

(73) Assignee: 3M Innovative Properties Company, St. Paul, MN (US)

( * ) Notice: Subject to any disclaimer, the term of this patent is extended or adjusted under 35 U.S.C. 154(b) by 199 days.

(21) Appl. No.: 10/474,279

(22) PCT Filed: Apr. 22, 2002

(86) PCT No.: PCT/US02/13006

§ 371 (c)(1),
(2), (4) Date: Oct. 7, 2003

(87) PCT Pub. No.: WO02/085769

PCT Pub. Date: Oct. 31, 2002

(65) Prior Publication Data

US 2004/0103991 A1 Jun. 3, 2004

(30) Foreign Application Priority Data

Apr. 24, 2001 (JP) ..... 2001-126559

(51) Int. Cl.
*B65H 35/00* (2006.01)

(52) U.S. Cl. ..... 156/60; 156/324; 156/574

(58) Field of Classification Search ..... 156/574, 156/579, 391

See application file for complete search history.

(56) References Cited

U.S. PATENT DOCUMENTS 1,901,908 A 3/1933 Hoyos
3,645,831 A 2/1972 Thaler
3,658,628 A * 4/1972 Zenter ..... 156/527
3,725,182 A * 4/1973 Regan ..... 156/527
4,623,421 A 11/1986 Cardin
6,029,729 A * 2/2000 Sieber et al. ..... 156/577
6,098,685 A 8/2000 Maeda
6,302,177 B1 * 10/2001 Gruber ..... 156/527

FOREIGN PATENT DOCUMENTS

| | | |
|---|---|---|
| CH | 672481 | 11/1989 |
| DE | 88 16 290 | 7/1989 |
| DE | 4421285 | 6/1995 |
| DE | 19615315 | 4/1997 |
| EP | 0828041 | 3/1998 |

* cited by examiner

*Primary Examiner*—Richard Crispino
*Assistant Examiner*—Barbara J. Musser
(74) *Attorney, Agent, or Firm*—Harold C. Knecht, III

(57) ABSTRACT

Device for applying adhesive tape to a position in the width direction on an adherend surface linked to a neighboring surface via a folding line. The device comprises a pressing member with a surface attached pressingly to a surface of an adherend member, and at the same time, an edge between a sloping surface and an upper surface makes line contact with the neighboring surface near the folding line, thereby defining the position of the pressing member in the width direction relative to the adherend surface. The position of an adhesive tape relative to the pressing member is defined by an upper surface of a tape guide attaching member and a lower surface of a guide bar flange. Unapplied tape is guided by the guide bar and an unapplied tape guide, and a liner separated from the adhesive tape is guided by the guide bar and a liner guide.

21 Claims, 12 Drawing Sheets

DEVICE FOR ASSISTING THE APPLICATION OF ADHESIVE TAPE

FIELD OF THE INVENTION

The present invention relates to the application of adhesive tape and, particularly, to a device for assisting the application of adhesive tape to an adherend. The present invention is also related to an adhesive tape application method.

BACKGROUND OF THE INVENTION

Adhesive tapes are widely used in various fields. They are applied to adherend members having a wide variety of forms, so that the shape of adhesive tapes also varies widely.

One of the most difficult operations is that of applying a long adhesive tape to a designated position on an exterior surface of an automobile. This is because the exterior surface of an automobile body is in general a complicated curved surface and the adhesive tape is often non-linear in shape and non-uniform in the width. In addition, the operation of applying such an adhesive tape has to be performed while the automobile body is moving on the production line.

There is a case, for example, where an adhesive tape is to be adhered to an adherend surface that has a neighboring surface in linkage thereof via a folding line, keeping the side edge of the adhesive tape at a position separated by a predetermined distance from the folding line.

In such a case, the operator has to accomplish three tasks simultaneously, that is:

(1) to keep the position of the side edge at a constant distance from the folding line;

(2) to keep the unapplied portion yet to be applied and the liner of the adhesive tape from interfering with the application operation; and (3) to apply the adhesive tape using a squeezee or the like.

Thus, the operation is very difficult, and air bubbles are often formed in the interface between the adherend surface and the adhesive tape.

When an air bubble is formed in the interface between the adherend surface and the adhesive tape, the adhesive tape has to be pulled off up to the position of the bubble and to be applied again. If this is repeated several times, the adhesive tape may become deformed or no longer marketable, depending on the tape. Or, dust may stick to the tape, leading to another problem. In addition, the operation may not be completed within the specified process time.

Thus, a frequently adopted approach has been to assign two workers to this operation, so that while one is holding the tape with appropriate tension, the other may confirm the parting line and proceed with the application of the adhesive tape. This has resulted in an increase in labor costs for such operations.

SUMMARY OF THE INVENTION

In an effort to solve the above-described problem, the present invention provides a device that facilitates the operation of applying an adhesive tape to an adherend surface. It is desirable for the present invention to be suitable for applying an adhesive tape to an adherend surface that has a neighboring surface in linkage thereof via a folding line so as to keep the side edge of the adhesive tape at a predetermined distance from the folding line. It is also desirable for the present adhesive tape application device to be suitable for assisting in the operation of applying an adhesive tape to an adherend surface, where the adherend surface has a neighboring surface linked thereto via a folding line of the adherend member, so as to keep the adhesive tape at a predetermined position in the direction of the width of the tape. The present invention also provides an adhesive tape application method for solving the above-described problem.

In one aspect of the present invention, an adhesive tape application device is provided that comprises a pressing member having, and preferably consisting of, a first pressing portion being capable of pressing to the adherend surface and a second pressing portion connected to the first pressing portion and being capable of pressing to the neighboring surface when the first pressing portion splices to the adherend surface, a tape guide member which guides the adhesive tape mounted directly or indirectly to the pressing member, and a holding member connected to the pressing member for supporting the pressing member in such a manner that an operator can move the pressing member with the first pressing portion pressing to the adherend surface and the second pressing portion pressing to the neighboring surface, wherein the tape guide member includes a tape position defining member for defining the position of the adhesive tape in the width direction relative to the pressing member, an unapplied tape guide member for guiding the unapplied portion of the tape in a predetermined direction, and a liner guide member for guiding the liner separated from the adhesive tape in another predetermined direction.

With the adhesive tape application assisting device as described above, the position of the pressing member is, preferably, fixed by the first pressing portion and the second pressing portion in the width direction of the tape relative to the adherend surface, and the position of the adhesive tape in the width direction relative to the pressing member is fixed by the tape guide member, so that the adhesive tape can be aligned to a predetermined position in the width direction on the adherend surface. In addition, the tape guide member defines the extending direction of the unapplied portion of the tape and its liner separated from the adhesive tape.

It is desirable for the first pressing portion of the present device to be formed so as to make surface contact with the adherend surface. It can be desirable for the first pressing portion to be formed so as to make surface contact at two positions on the adherend surface separated in the direction of the progress of operation. It can also be desirable for the first pressing portion to be formed so as to make contact with the adherend surface at two positions separated in the width direction.

It is desirable for the second pressing portion to be formed so as to make surface contact with the neighboring surface. It can be desirable for the second pressing portion to be formed so as to make contact with the neighboring surface at two positions separated in the direction of the progress of operation. It can also be desirable for the second pressing portion to be formed so as to make contact with the neighboring surface at two positions separated in the width direction. In addition, the second pressing portion can be an edge, a plane or a surface of a circular cross section that makes line contact with the neighboring surface in parallel to the direction of the progress of operation. The second pressing portion can also be a spherical surface making point contact with the neighboring surface. Furthermore, the second pressing portion can be folded from one end in the width direction of the first pressing portion downward in the direction to the lower surface of the first pressing portion or upward in the direction to the upper surface of the first pressing portion. In one embodiment of such a device, a cutaway is formed in the boundary between the second pressing portion and the first pressing portion.

It is desirable for the tape guide member to be disposed on the rear side in the direction of the progress of the pressing member, while being attached to a tape guide member attaching member one end of which is mounted to the rear surface of the pressing member. With such a device, it can be desirable for the tape position defining member to be comprised of a guide bar in the form of a bar one end of which is attached to the tape guide member attaching member and which extends in parallel to the first pressing portion of the pressing member, and a flange member having larger area than the cross section of the bar-form member, position of the tape in the width direction being defined by the tape guide member attaching member and the flange member. With such a device, it can also be desirable for the unapplied tape guide member to comprise a guide bar and an unapplied tape guide block attached to the tape guide member attaching member. Also with this device, it can be desirable for the liner guide member to comprise a guide bar and a liner guiding block attached to the rear surface of the pressing member. For this device, the tape guide member attaching member can also serve as a supporting member.

In another aspect of the present invention, an adhesive tape application method is provided that uses the above described device(s) for assisting the application of an adhesive tape.

In one embodiment of this method, the position of the pressing member is fixed by the first pressing portion and the second pressing portion in the width direction relative to the adherend surface, and the position of the adhesive tape in the width direction relative to the pressing member is fixed by the tape guide member so that the adhesive tape can be aligned to the predetermined position in the width direction of the adherend surface. In addition, the extending direction of the unapplied portion of the adhesive tape, and of the liner separated from the adhesive tape is defined by the tape guide member.

BRIEF DESCRIPTION OF THE DRAWINGS

FIG. 3 is a view showing the application assisting device of FIG. 1 as seen from above, in which:

(A) shows a case where the adherend surface is a plane, (B) shows a case where the adherend surface is concave in the direction of the progress of operation, (C) shows a case where the adherend surface is convex in the direction of the progress of operation, (D) shows a countermeasure in order to ensure stable operation in the case (C).

Figure 1:
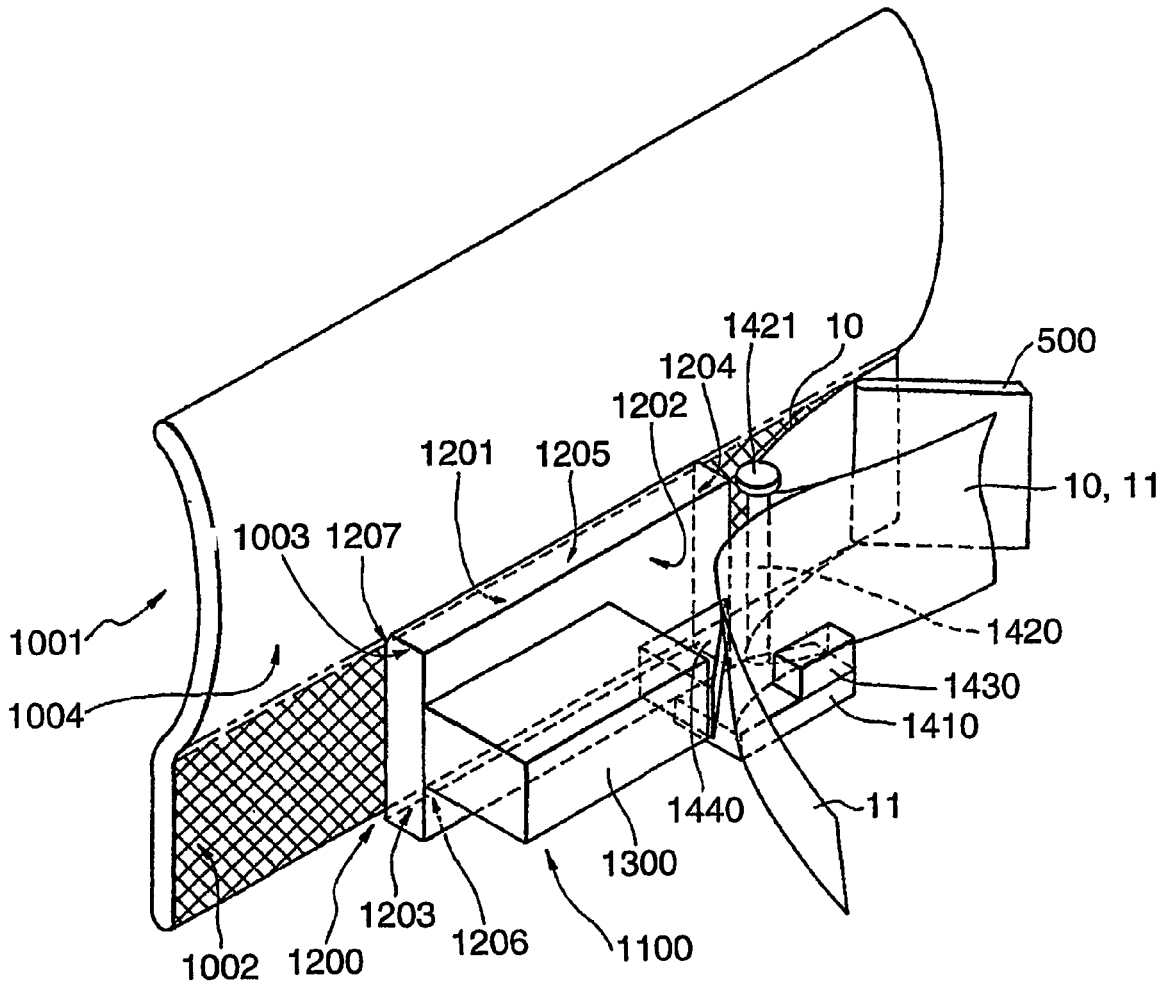
FIG. 1 is a perspective view useful for explaining a first embodiment of the present invention.

FIG. 4 is a view showing the application assisting device of FIG. 1 as seen from the direction of the back surface of the pressing member, in which;

(A) shows a case where the adherend surface is a plane, (B) shows a case where the adherend surface is concave in the direction of height, (C) shows a case where the adherend surface is convex in the direction of height, (D) shows a countermeasure in order to ensure stable operation in the case (C).

Figure 5:
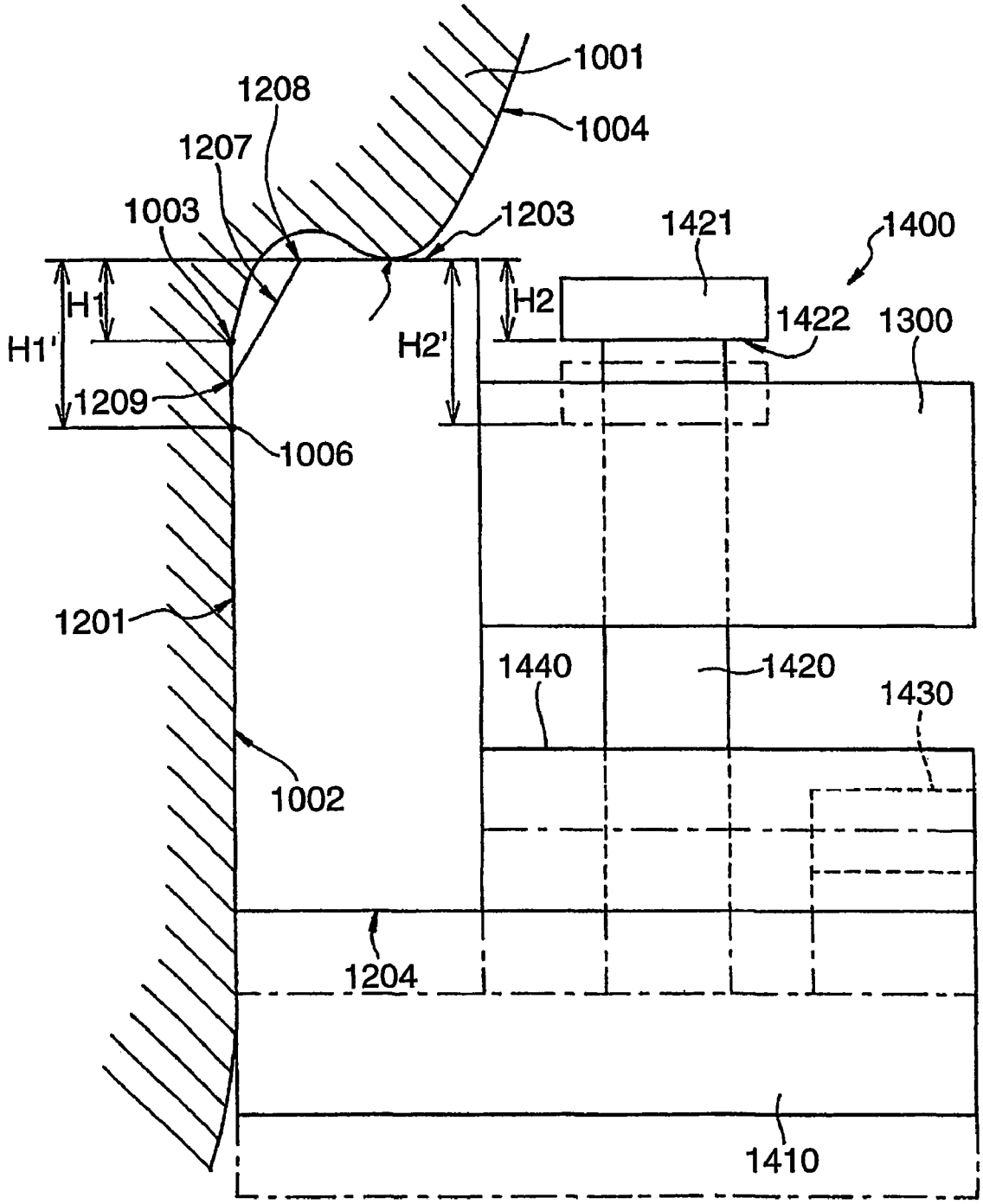

FIG. 5 is a view showing the first embodiment of the present invention applied to the case where the neighboring surface has a sag.

Figure 6:
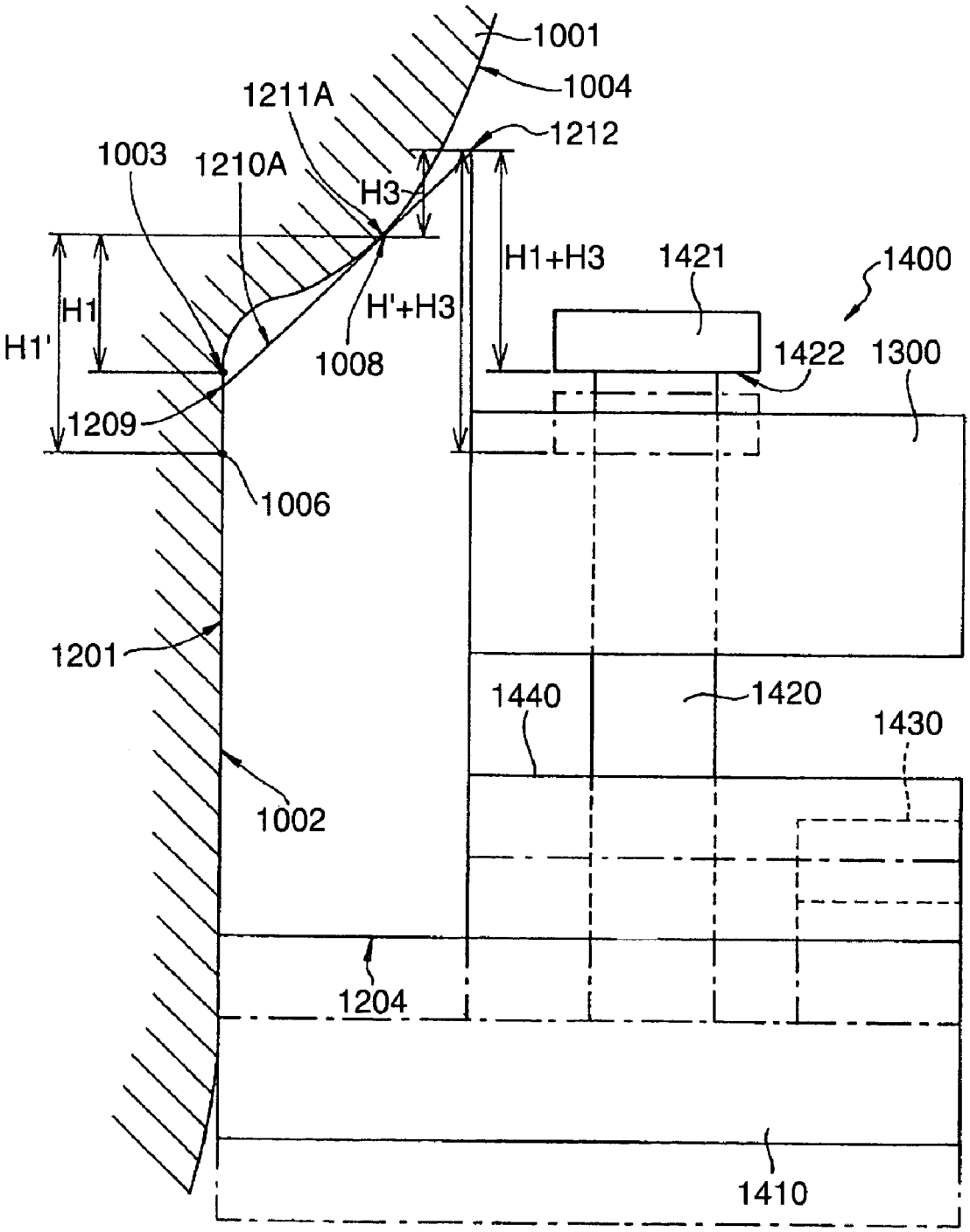

FIG. 6 is a view useful for explaining a first modification of the first embodiment.

Figure 7:
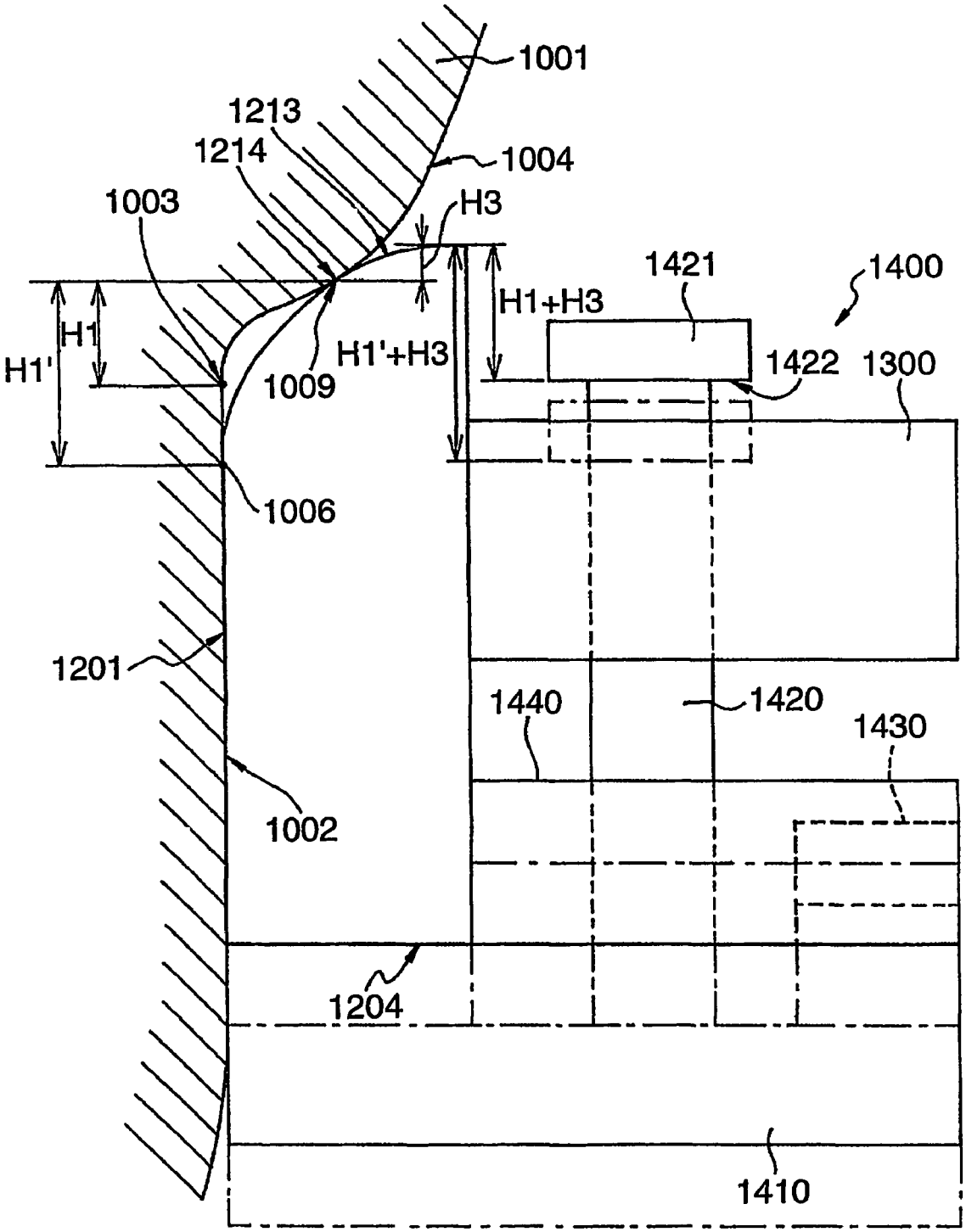

FIG. 7 is a view useful for explaining a second modification of the first embodiment.

Figure 8:
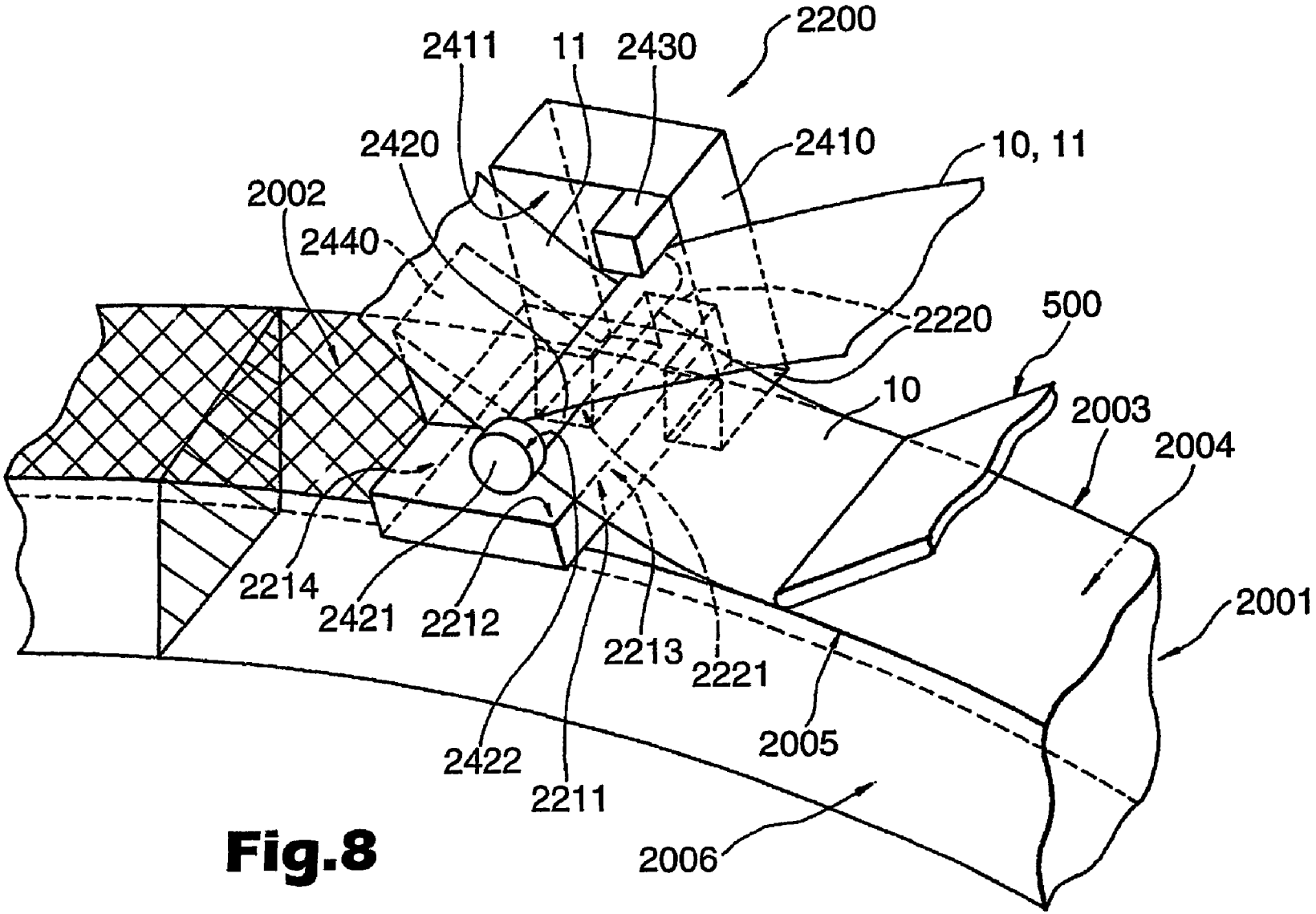

FIG. 8 is a perspective view showing a second embodiment of the present invention.

Figure 9:
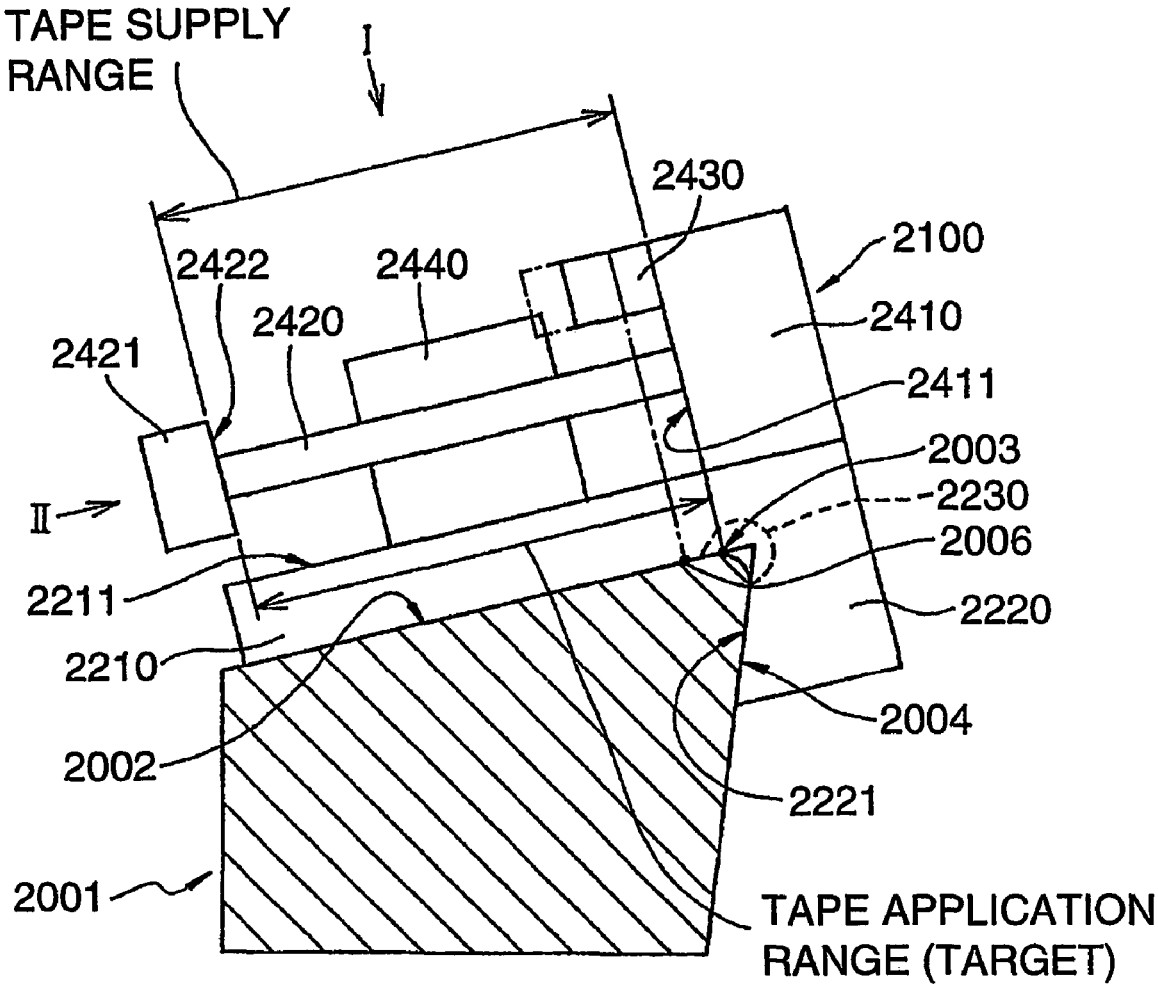

FIG. 9 is an enlarged view of the application assisting device of FIG. 8 as seen from the front side in the direction of the progress of operation.

Figure 10:
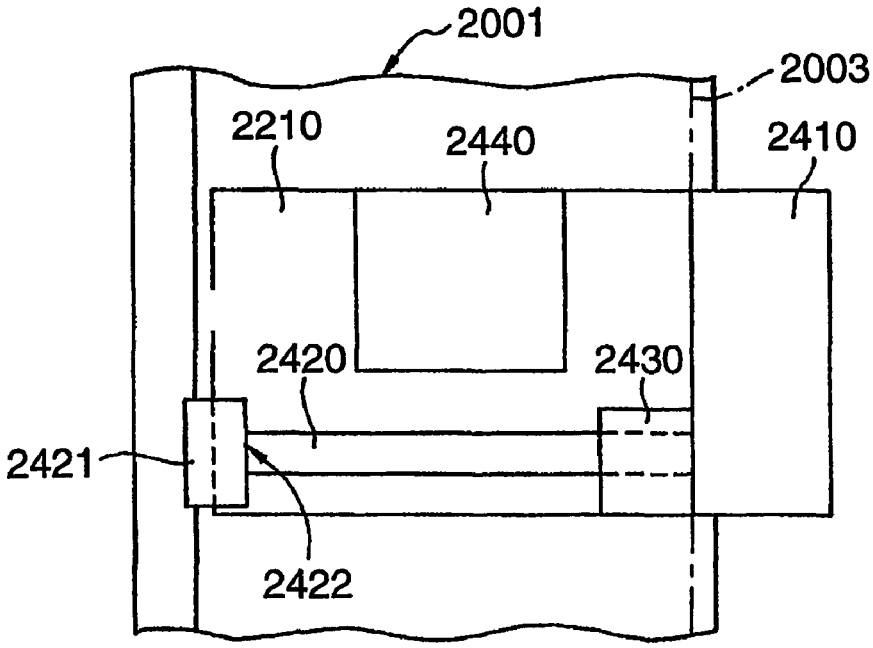

FIG. 10 is a view showing the application assisting device of FIG. 9 as seen from the direction I in FIG. 9.

Figure 11:
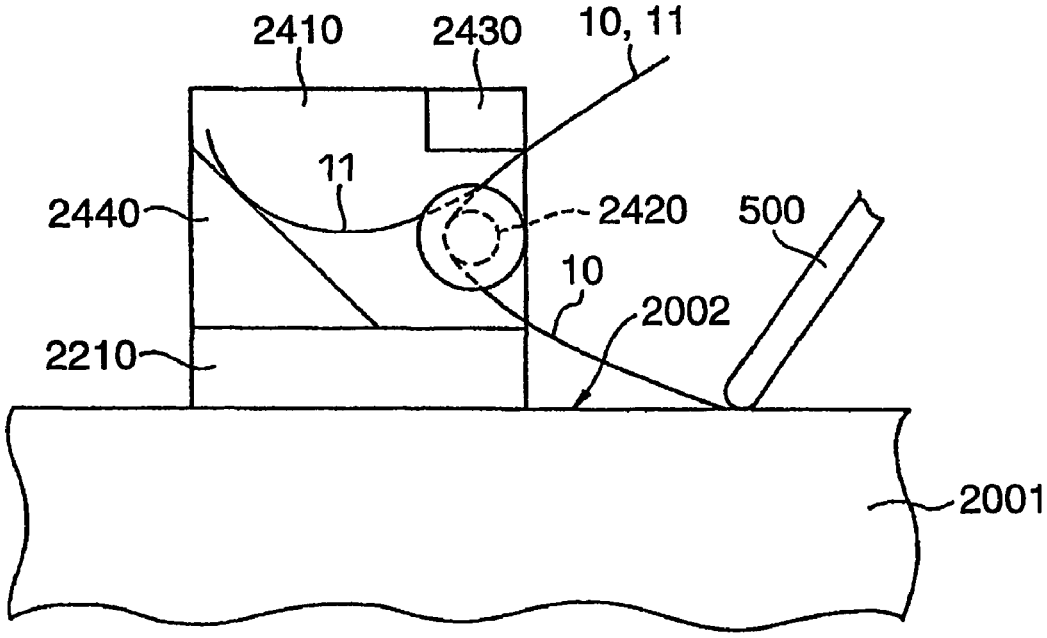

FIG. 11 is a view showing the application assisting device of FIG. 9 as seen from the direction II in FIG. 9.

Figure 12:
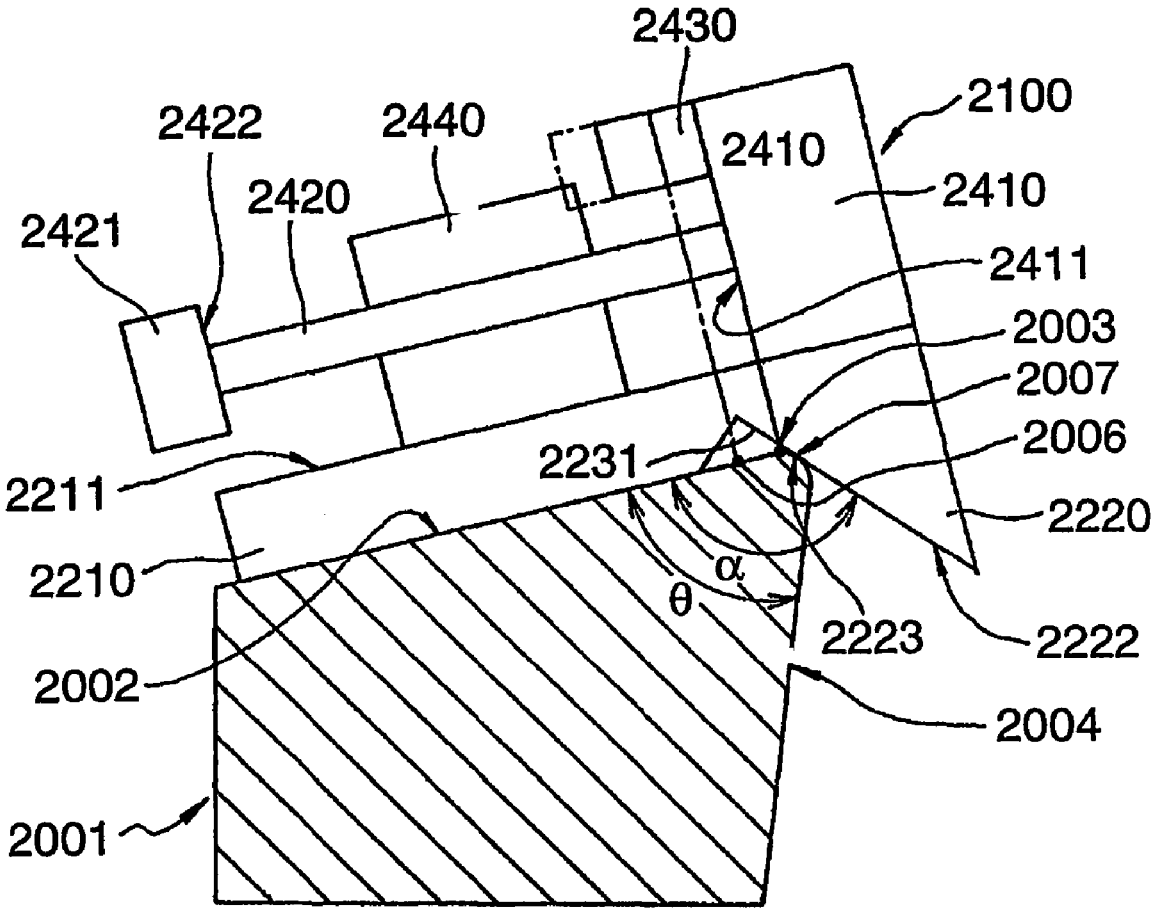

FIG. 12 is a view useful for explaining a first modification of the second embodiment.

Figure 13:
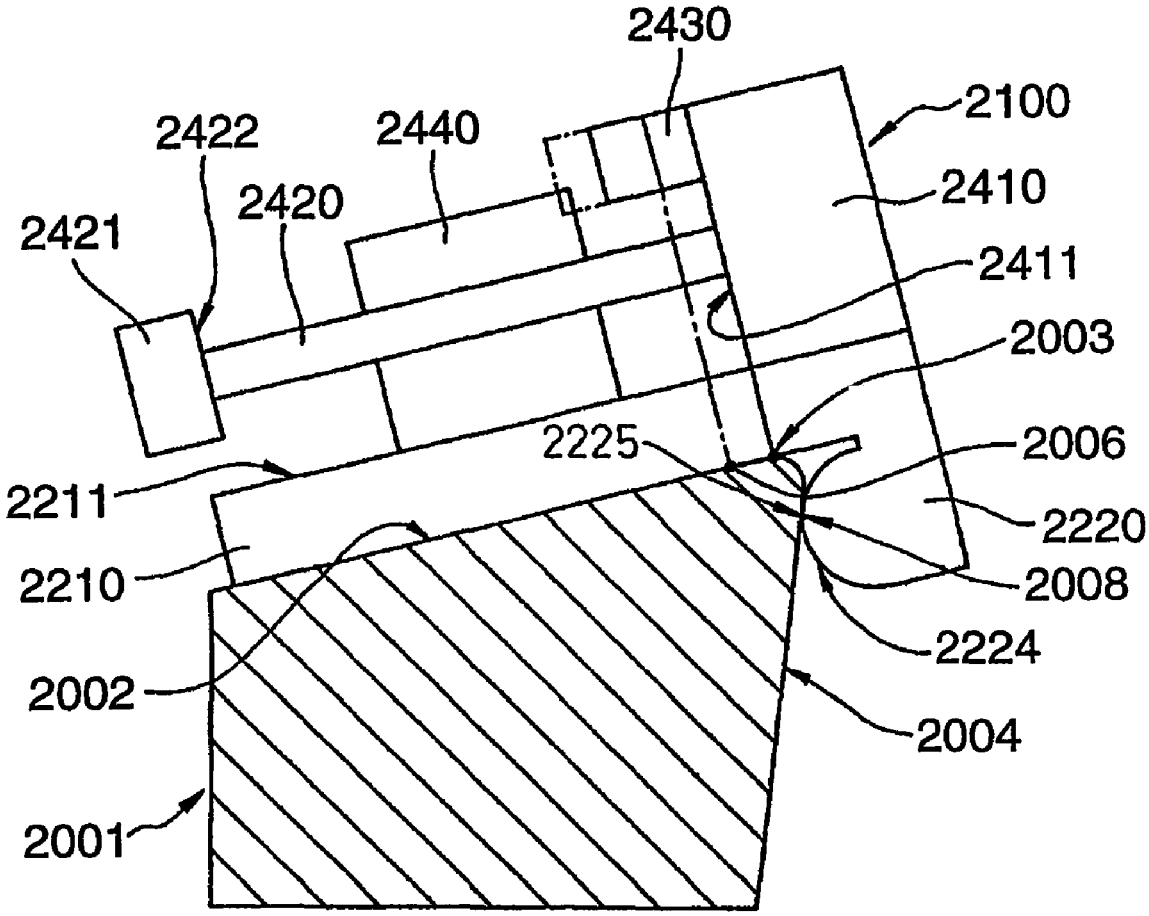

FIG. 13 is a view useful for explaining a second modification of the second embodiment.

DETAILED DESCRIPTION OF THE INVENTION

The present invention will now be described in detail with reference to drawings showing embodiments thereof. Beginning with a first embodiment, FIG. 1 is a perspective view useful for explaining the construction and operation of a device for assisting application of an adhesive tape according to the first embodiment of the present invention.

An adherend member 1001 as shown in FIG. 1 is an exterior plate member of an automobile, with an adherend surface 1002 being shown in cross hatching. As shown in FIG. 1, a neighboring surface 1004 projecting to the foreground is linked to the adherend surface 1002 with a folding line 1003 shown in dashed dotted line as a boundary.

The application assisting device 1100 for application of the adhesive tape is comprised of a pressing member 1200, a knob 1300 as a holding member for an operator to hold the pressing member 1200, and a tape guide member 1400 for guiding the adhesive tape 10.

As shown in the figure, the pressing member 1200 is formed in the shape of a rectangular block having a pressing surface 1201 to be attached pressingly to the adherend surface 1002 of the adherend member 1001, a back surface 1202, a front surface 1203 positioned in the front during the progress of operation, a rear surface 1204 positioned in the rear during the progress of operation, an upper surface 1205, and a lower surface 1206. The pressing surface 1201 and the upper surface 1205 are linked via a sloping surface 1207 (see FIG. 2). In this embodiment, the sloping surface 1207 defines an intermediate portion.

Although the knob 1300 is attached to the back surface 1202 of the pressing member 1200 in this example, it may be formed integrally with the pressing member 1200.

The tape guide member 1400 is comprised of a guide bar 1420 of circular shape in cross section projectingly attached to a tape guide member attaching member 1410 mounted on the lower surface 1203 of the pressing member 1200, an unapplied tape guide member 1430, and a liner guide member 1440 mounted on the back surface 1202 of the pressing member 1200.

Figure 2:
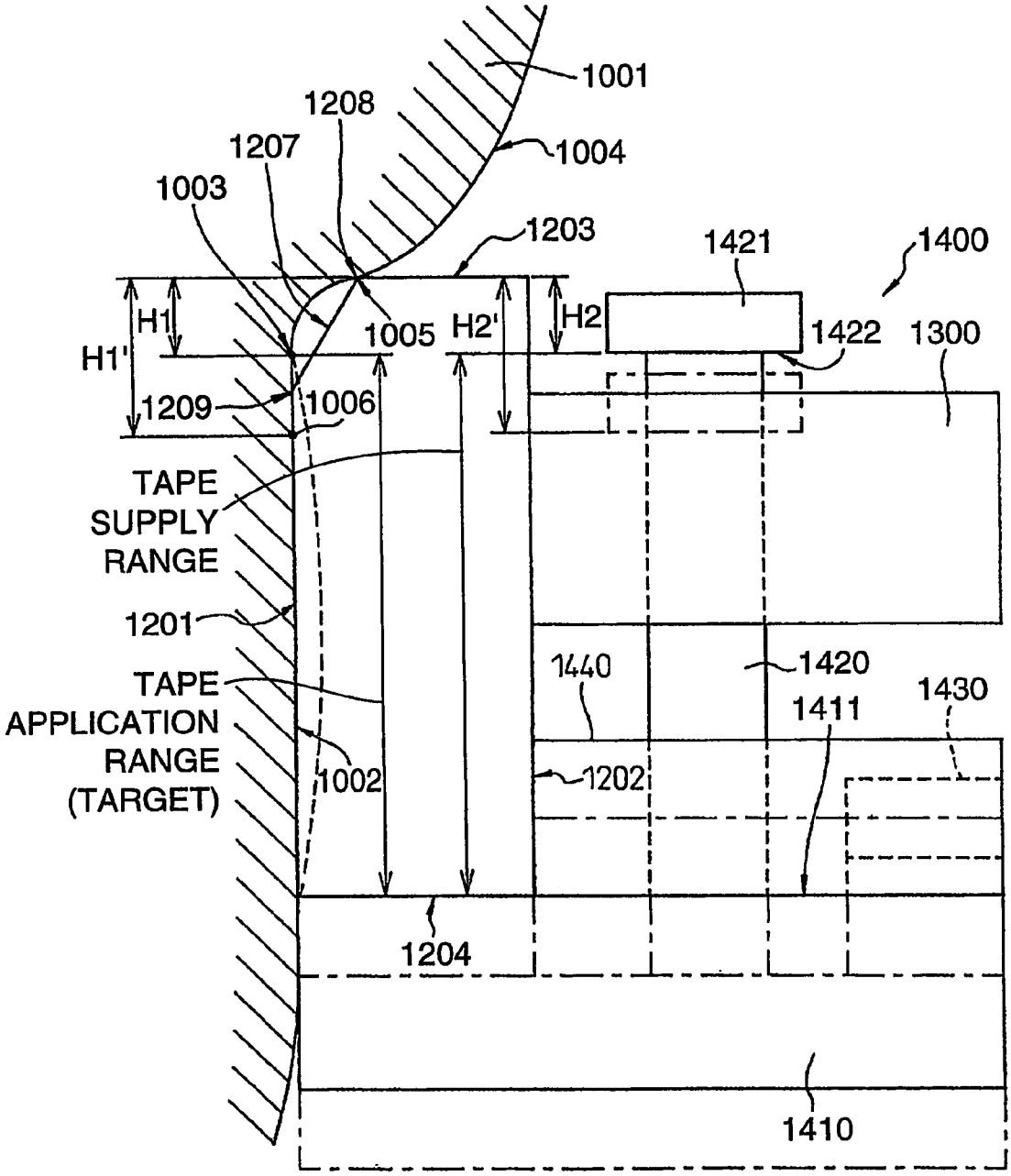
FIG. 2 is an enlarged view of the application assisting device of FIG. 1 as seen from the front side in the direction of the progress of operation.
Figure 3A:
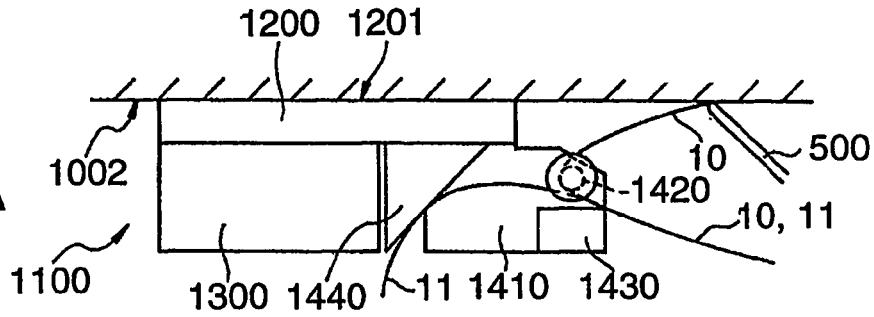
Figure 3B:
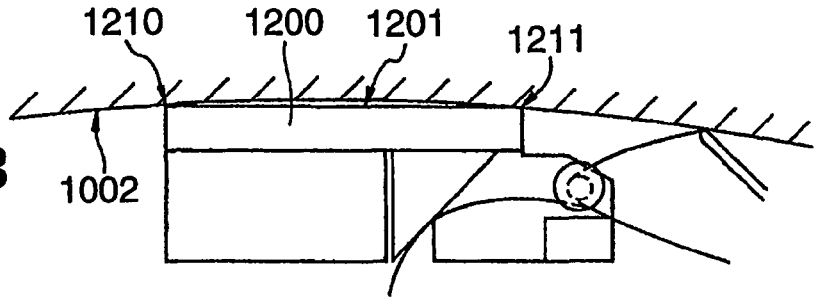
Figure 3C:
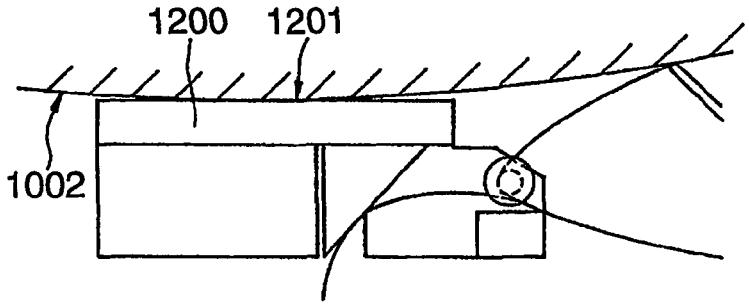
Figure 3D:
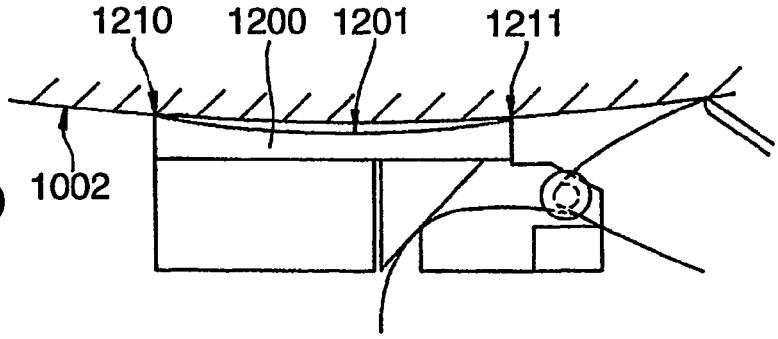
Figure 4A:
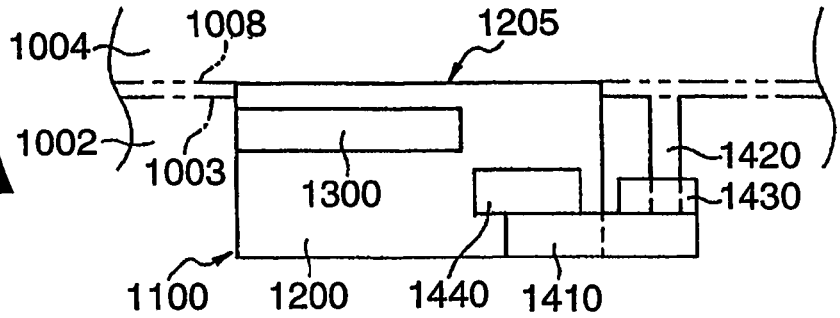
Figure 4B:
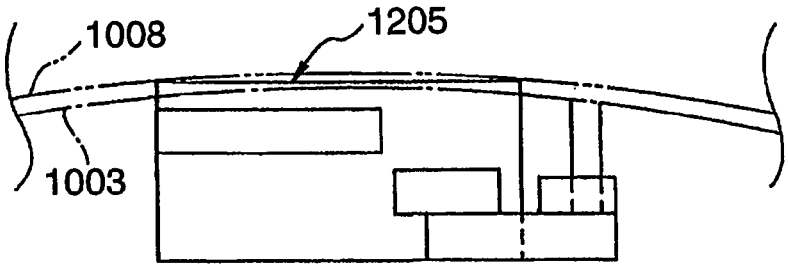
Figure 4C:
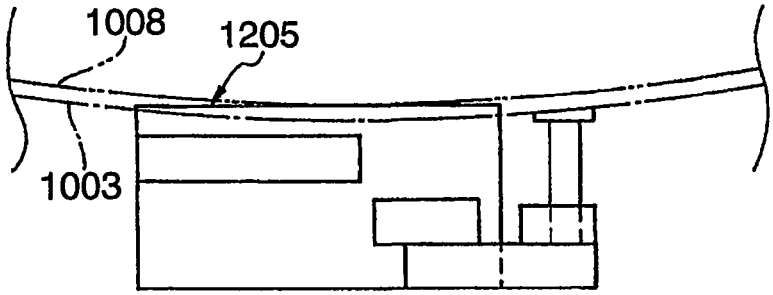
Figure 4D:
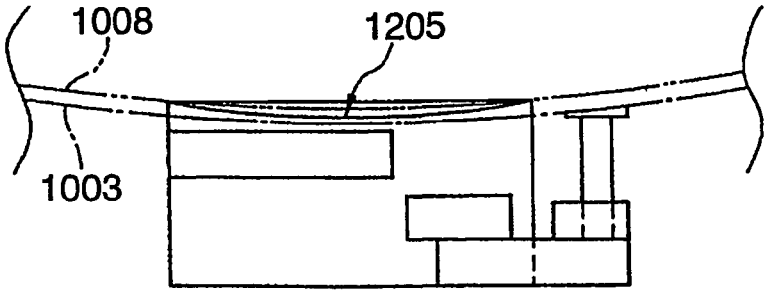

FIG. 2 is an enlarged view of the application assisting device of FIG. 1 as seen from the front side in the direction of the progress of operation. When the pressing surface 1201 of the pressing member 1200 is attached pressingly to the adherend surface 1002 of the adherend 1001, the edge forming the boundary between the sloping surface 1207 and the upper surface 1203 is simultaneously caused to contact with the neighboring surface 1004 near the folding line 1003 of the adherend member 1001. In this manner, the position of the pressing member 1200 in the width direction is fixed relative to the adherend member 1001.

When the pressing surface 1201 is attached pressingly to the adherend surface 1201, the edge 1209 forming the boundary between the sloping surface 1207 and the pressing surface 1201 is located lower than the folding line 1003, as shown in FIG. 2, so that the edge 1208 is capable of contacting with the neighboring surface 1004.

If the adherend surface 1002 of the adherend member 1001 is a convex surface, the pressing surface 1201 is to be formed in a concave form as shown in dashed line in FIG. 2, where the radius of curvature of the concave surface needs to be smaller than the radius of curvature of the convex portion of the adherend surface 1002.

On the other hand, the guide bar 1420 of the tape guide member 1400 has a flange 1421 that is larger than the diameter of the guide bar 1420 mounted to the upper end thereof, the distance between the lower surface 1422 of the flange 1421 and the upper surface 1411 of the tape guide member attaching member 1410 being such that it permits an unapplied adhesive tape 10 to pass through without fluctuating in the direction of the width. The position of the adhesive tape 10 in the width direction relative to the tape guide member 1400 is thereby defined.

The distance H1 in the direction of height between the height position of an edge contact line 1005 where the edge 1208 of the pressing member 1200 contacts with the neighboring surface 1004 of the adherend member 1001 and the height position of the folding line 1003 is a value that can be known beforehand.

The height position of an edge contact line 1005 is the same as the height position of the upper surface 1205 of the pressing member 1200.

Therefore, if the distance H2 in the direction of height between the upper surface 1205 of the pressing member 1200 and the lower surface of the flange 1421 mounted to the guide bar 1420 of the tape guide member 1400 is made to be equal to the afore-mentioned H1, the adhesive tape 10 can be applied to the adherend surface 1002 with the upper edge of the adhesive tape 10 aligned with the folding line 1003 of the adherend member 1001.

If the upper edge of the adhesive tape 10 is to be aligned, not with the folding line 1003 but with an imaginary line 1006 in parallel to the folding line 1003, the tape guide member 1400 needs only to be disposed relative to the pressing member 1200 such that the distance H2' in the direction of height between the upper surface 1205 of the pressing member 1200 and the lower surface of the flange 1421 coincides with the distance H1' in the direction of height between the edge contact line 1005 and the imaginary line 1006.

Referring again to FIG. 1, arrangement of the adhesive tape 10 and various guides will be next described. The adhesive tape in unapplied state has a liner 11 applied thereto, and is fed from the rear side in the direction of progression so as to pass between the guide bar 1420 and the unapplied tape guide member 1430 to be separated from each other near the guide bar 1420. Then, the adhesive tape goes around the guide bar 1420 for about half the circumference, comes out to the rear side and is applied to the adherend surface 1002 by the operator using a squeegee 500. The liner 11 impinges onto a liner guide 1440 and is discharged in the direction departing from the pressing member 1200.

FIG. 3 is a view as seen from above showing the application assisting device 1100 for application of the adhesive tape according to the first embodiment with the pressing surface 1201 of the pressing member 1200 attached pressingly onto the adherend surface 1002.

In FIG. 3, (A) shows a case where the adherend surface 1002 is a plane.

In FIG. 3, (B) shows a case where the adherend surface 1002 is concave in the longitudinal direction. In this case, the pressing member 1200 can be stably supported by the contact of the edge 1210 forming the boundary between the pressing surface 1201 and the front surface 1203, and the edge 1211 forming the boundary between the pressing surface 1201 and the rear surface 1204, with the pressing surface 2, thereby ensuring stable operation.

In FIG. 3, (C) shows a case where the adherend surface 1002 is convex in the longitudinal direction. In this case, the pressing surface 1201 cannot fully contact with the pressing surface 2, and only a range in the longitudinal direction (strictly, only a line extending in the up-down direction) can contact with it.

In FIG. 3, (D) shows a countermeasure in order to ensure stable operation in the case where, as in (C), the adherend surface 1002 is convex in the longitudinal direction. For this purpose, the pressing surface 1201 of the pressing member 1200 is made concave with the radius of curvature smaller than the radius of curvature of the convex adherend surface 1002. In this manner, the pressing member 1200 can be stably supported by the contact of the edge 1210 forming the boundary between the pressing surface 1201 and the front surface 1203, and the edge 1211 forming the boundary between the pressing surface 1201 and the rear surface 1204, with the pressing surface 1002, thereby ensuring stable operation even when the adherend surface 1002 is convex in the longitudinal direction. Preferably, the edge 1210 and the edge 1211 are of a rounded shape so as not to damage the adherend surface 1002.

FIG. 4 is a view showing the application assisting device 1100 for application of the adhesive tape according to the first embodiment as seen from the direction of the back surface 1202 of the pressing member. The folding line 1003 is shown in dashed dotted line and the edge contact line 1005 that is determined accordingly is shown in dashed double dotted line.

In FIG. 4, (A) shows a case where the folding line 1003 and the edge contact line 1005 are straight lines.

In FIG. 4, (B) shows a case where the folding line 1003 and the edge contact line 1005 are convex curves in upward direction. In this case, the pressing member 1200 contacts at a front end corner 1208F and a rear end corner 1208R of the edge 1208 with the edge contact line 1005, thereby ensuring stable operation.

In FIG. 4, (C) shows a case where the folding line 1003 and the edge contact line 1005 are convex curves in downward direction. In this case, the edge 1208 of the pressing member 1200 cannot completely contact with the adherend surface 1002, but only a range extending longitudinally (strictly, only a point) can contact with it.

In FIG. 4, (D) shows a countermeasure in order to ensure stable operation in the case where, as in (C), the folding line 1003 and the edge contact line 1005 are convex curves in downward direction. For this purpose, the upper surface 1205 of the pressing member 1200 is made concave with the radius of curvature smaller than the radius of curvature of the folding line 1003 and the edge contact line 1005. In this manner, even when the folding line 1003 and the edge contact line 1005 are convex curves in downward direction, the front end corner 1208F and the rear end corner 1208R of the edge 1208 of the pressing member 1200 can contact with the edge contact line 1005 of the adherend surface 1002, thereby ensuring stable operation. Preferably, the corner 1208F and the corner 1208R are of a rounded shape so as not to damage the adherend surface 1002.

As shown in FIG. 5, the first embodiment is also applicable to the case where the neighboring surface 1004 has a sag. In this case, the edge 1208 of the pressing member 1200 do not contact with the neighboring surface 1004. Instead, the upper surface 1203 contacts with the lowest portion of the sag of the neighboring surface 1004. If the sag deviates from the upper surface in the direction of the back surface, only the thickness of the pressing member needs to be increased. In this embodiment, the sloping surface 1207 defines at least a part of an intermediate portion.

FIG. 6 is a view useful for explaining a first modification of the first embodiment. In this first modification, a large sloping surface 1210A extending to the back surface 1202 is formed on the upper end of the pressing member 1200. As a result, horizontal upper surface 1203 does not exist and a contact line 1211A on the sloping surface contacts with a contact line 1008 on the neighboring surface 1004. The portion of the sloping surface 1210A from edge 1209 to the contact line 1211A defines an intermediate portion. The distance H1 in the direction of height between the contact line 1008 and the folding line 1003 can be known beforehand and is constant, and the distance H3 in the direction of height between the contact line 1211A and the upper end (=upper end of the back surface 1202) 1212 also can be known beforehand and is constant. Therefore, by aligning the lower surface 1422 of the flange 1421 of the tape guide member 1400 with the position displaced downward from the upper end 1212 of the sloping surface 1210A by H1+H3, the adhesive tape 10 can be applied with the upper edge coinciding with the folding line 1003.

In order to apply the adhesive tape 10 in such away that the upper edge coincides with an imaginary line 1006 lower than the folding line 1003, it suffices to replace H1 with the distance H1' in the direction of height between the contact line 1008 and the imaginary line 1006, as in the first embodiment.

FIG. 7 is a view useful for explaining a second modification of the first embodiment. In this second modification, a large convex circular arc surface 1213 is formed on the upper end of the pressing member 1200 from the pressing surface 1201 extending to the back surface 1202. As a result, a contact line 1214 on the circular arc surface 1213 contacts with a contact line 1009 on the neighboring surface 1004. The portion of the arc surface 1213 from the pressing surface 1201 to the contact line 1214 defines an intermediate portion. In the same manner as in the first embodiment, the adhesive tape 10 can be applied in such a way that the upper edge coincides with the folding line 1003 or the imaginary line 1006.

Next, a device for assisting application of an adhesive tape according to a second embodiment of the present invention will be described.

FIG. 8 is a view useful for explaining the second embodiment of the present invention. In this second embodiment, an adherend surface 2002 of an adherend member 2001 to which the adhesive tape 10 is to be applied is shown in cross hatching as in the first embodiment. The adherend surface 2002 is a surface portion of a member of deformed quadrilateral in cross section, having a neighboring surface 2004 folded downward with a folding line 2003 as a boundary and another neighboring surface 2006 folded downward with a folding line 2005 as a boundary.

In this second embodiment, the adhesive tape 10 is applied using the neighboring surface 2004.

The application assisting device 2100 according to the second embodiment is comprised of a pressing member 2200 and a tape guide member 2400 for guiding the adhesive tape 10.

As shown in the figure, the pressing member 2200 is comprised of a main block 2210 of generally rectangular shape and two subblocks 2220 integrally formed with the main block 2210. The main block 2210 includes a pressing surface 2211 to be attached pressingly to the adherend surface 2002 of the adherend member 2001, an upper (in the figure) surface 2212, a front surface 2213 positioned in front during the progress of operation, and a rear surface 2214 positioned in the rear during the progress of operation.

The subblock 2220 includes pressing surface 2221 to be attached pressingly to the neighboring surface 2004 of the adherend member 2001.

The tape guide member 2400 is comprised of a guide bar 2420 of circular shape in cross section mounted on the upper surface 2212 of or integrally formed with the main block 2210, an unapplied tape guide member 2430, and a liner guide member 2440 mounted on the upper surface 2212 of the main block 2210.

Since an operator can grasp a tape guide member attaching member 2410, there is no dedicated knob as seen in the first embodiment.

FIG. 9 is an enlarged view as seen from the front side in the direction of the progress of operation. The pressing member 2200 is fixed with the pressing surface 2211 of the main block 2210 being attached pressingly to the adherend surface 2002 of the adherend member 2001, and in addition, with the pressing surface 2221 of the subblock 2220 being in contact with the neighboring surface 2004. In this manner, the position of the pressing member 2200 in the width direction is fixed relative to the adherend member 2001.

A cutaway 2230 as shown in dashed line may be provided at the portion where the pressing surface 2211 of the main block 2210 and the pressing surface 2221 of the subblock 2220 meet, so that, even if the folding line 2003 of the adherend member 2001 is a sharp edge, the pressing surface 2211 of the main block 2210 and the pressing surface 2221 of the subblock 2220 can be attached pressingly to the adherend surface 2002 and the neighboring surface 2004, respectively. The cutaway 2230 defines an intermediate portion.

On the other hand, as in the first embodiment, the guide bar 2420 of the tape guide member 2400 has a flange 2421 that is larger than the diameter of the guide bar 2420 mounted to the upper end thereof, the distance between the lower surface 2422 of the flange 2421 and the foreground surface 2411 of the tape guide member attaching member 2410 being such that it permits an unapplied adhesive tape 10 to pass through without fluctuating in the direction of the width. The position of the adhesive tape 10 in the direction of the width relative to the tape guide member 2400 is thereby defined.

Since the line extending the foreground surface 2411 of the tape guide member attaching member 2410 is made to pass through the folding line 2003 of the adherend 2001, the adhesive tape 10 can be applied in such a way that one end thereof in the width direction coincides with the folding line 2003. If the adhesive tape 10 is to be applied in such a way that one end thereof in the width direction coincides, not with the folding line 2003, but with an imaginary line 2006 in parallel to the folding line 2003, it suffices to shift the mounting position of the tape guide member attaching member 2410 so that the line extending the foreground surface 2411 of the tape guide member attaching member 2410 passes through the imaginary line 2006.

FIG. 10 is a view showing the application assisting device of FIG. 9 as seen from the direction I in FIG. 9; and FIG. 11 is a view showing the application assisting device of FIG. 9 as seen from the direction II in FIG. 9.

As has been described with reference to FIG. 3 showing the first embodiment, when the adherend surface 2002 of the adherene member 2001 is convex, it suffices to make the pressing surface 2211 of the main block 2210 of the application assisting device 2100 for application of the adhesive tape concave in the direction of the progress of operation. On the other hand, when the neighboring surface 2004 of the adherend member 2001 is convex, there is no problem since the subblock 2220 is divided in two in the direction of the progress of operation.

FIG. 12 is a view showing a first modification of the second embodiment. In this modification, the subblock 2220 has a pressing surface 2222 for which the inclination angle a relative to the pressing surface 2211 of the main block 2210 is an obtuse angle, and the two surfaces are linked via a cutaway portion 2231. The cutaway portion 2231 defines an intermediate portion.

In this manner, a contact line 2223 on the pressing surface 2222 of the subblock 2220 can make line contact with a contact line 2007 on the neighboring surface 2004 near the folding line 2003 of the adherend member 2001, thereby defining the position of the application assisting device 2100 for application of adhesive tape in the width direction relative to the adherend member 2001, so that the adhesive tape can be applied in a predetermined position in the width direction.

This first modification of the second embodiment can accommodate to variation of the crossing angle θ between the adherend surface 2002 and the neighboring surface 2004 of the adherend member 2001.

FIG. 13 is a view showing a second modification of the second embodiment. In this modification, the subblock 2220 has a rounded, or spherical, pressing surface 2224. In this manner, a contact line 2225 on the pressing surface 2224 of the subblock 2220 can make line contact (point contact in the case of a spherical surface) with a contact line 2008 on the neighboring surface 2004 of the adherend member 2001, thereby defining the position of the application assisting device 2100 for application of adhesive tape in the width direction relative to the adherend member 2001, so that the adhesive tape can be applied in a predetermined position in the width direction. The cutaway portion of the block 2210 near the folding line 2003 of the adherend to the contact line 2225 defines an intermediate portion.

This second modification of the second embodiment can also accommodate to variation of the crossing angle θ between the adherend surface 2002 and the neighboring surface 2004 of the adherend member 2001, and indeed can accommodate to wider variation than the first modification.

The application assisting device for application of an adhesive tape according to claims 1 through 18 is an assisting device for assisting operation of applying the adhesive tape to a predetermined position in the width direction on an adherend surface having a neighboring surface in linkage thereof via a folding line, and is comprised of a pressing member consisting of a first pressing portion being capable of pressing to the adherend surface and a second pressing portion being capable of pressing to the neighboring surface when the first pressing portion splices to the adherend surface, a tape guide member which guides the adhesive tape mounted directly or indirectly to the pressing member, and a holding member connected to the pressing member for supporting the pressing member in such a manner that an operator can move the pressing member with the first pressing portion pressing to the adherend surface and the second pressing portion pressing to the neighboring surface, wherein the tape guide member includes a tape position defining member for defining the position of the adhesive tape in the direction of the width of the tape relative to the pressing member, unapplied tape guide member for guiding the unapplied portion of the tape in a predetermined direction, and a liner guide member for guiding the liner separated from the adhesive tape in another predetermined direction.

Thus, the position of the pressing member is fixed by the first pressing portion and the second pressing portion in the width direction of the tape relative to the adherend surface, and the position of the adhesive tape is fixed by the tape guide member in the width direction of the tape relative to the pressing member, so that the adhesive tape can be aligned to a predetermined position in the width direction on the adherend surface. In addition, the tape guide member defines the extending direction of the unapplied portion of the tape and the liner separated from the adhesive tape, thereby eliminating the need for directing them.

According to an adhesive tape application method using this assisting device for application of an adhesive tape as claimed in claim 19, an operator needs only to hold the pressing member and exert necessary pressure on the adhesive tape, so that errors in operation such as positioning error, etc. are less likely to happen, resulting in the reduction of manufacturing cost.

I claim:

1. A device in combination with adhesive tape and an adherend member defining a body part of a vehicle, said device for assisting application of said adhesive tape to an adherend surface on said adherend member having a neighboring surface, said device comprising:

a pressing member comprising a first non-rotatable pressing portion being capable of pressing to said adherend surface, and a second pressing portion being capable of pressing to said neighboring surface when said first pressing portion is pressingly in contact with said adherend surface, said first pressing portion and said second pressing portion being interconnected to one another by an intermediate portion, said first, second and intermediate portions forming part of the same continuous surface and being configured so that said intermediate portion defines a non-pressing portion; and a tape guide member for guiding said adhesive tape, wherein said second pressing portion is at an oblique angle from said first pressing portion.

2. A combination according to claim 1, wherein said body part is an automobile body part.

3. A device in combination with adhesive tape and an adherend member defining a body part of a vehicle, said device for assisting application of said adhesive tape to an adherend surface on said adherend member having a neighboring surface, said device comprising:

a pressing member comprising a first non-rotatable pressing portion being capable of pressing to said adherend surface, and a second pressing portion being capable of pressing to said neighboring surface when said first pressing portion is pressingly in contact with said adherend surface, said first pressing portion and said second pressing portion being interconnected to one another by an intermediate portion, said first, second and intermediate portions forming part of the same continuous surface and being configured so that said intermediate portion defines a non-pressing portion, at least a section of said intermediate portion and said second pressing portion being curved; and a tape guide member for guiding said adhesive tape.

4. A combination according to claim 3, wherein said body part is an automobile body part.

5. A device in combination with adhesive tape and an adherend member defining a body part of a vehicle, said device for assisting application of said adhesive tape to an adherend surface on said adherend member having a neighboring surface, said device comprising:

a pressing member comprising a first non-rotatable pressing portion being capable of pressing to said adherend surface, and a second pressing portion being capable of pressing to said neighboring surface when said first pressing portion is pressingly in contact with said adherend surface, said first pressing portion and said second pressing portion being interconnected to one another by an intermediate portion having at least a planar section extending at an oblique angle to at least one of said first and second pressing portions and defining a cutaway formed between said second pressing portion and said first pressing portion, said first, second and intermediate portions forming part of the same continuous surface and being configured so that said intermediate portion defines a non-pressing portion; and a tape guide member for guiding said adhesive tape comprising a tape position defining member for defining the position of said adhesive tape in a width direction relative to said pressing member and an unapplied tape guide member for guiding an unapplied portion of said tape in a direction, said tape position defining member comprising a guide bar in the form of a bar one end of which is attached to a tape guide member attaching member.

6. A combination according to claim 5, wherein said first pressing portion is formed so as to make surface contact with said adherend surface.

7. A combination according to claim 5, wherein said first pressing portion is formed so as to make contact with said adherend surface at two positions separated in the direction of the progress of operation.

8. A combination according to claim 5, wherein said first pressing portion is formed so as to make contact with said adherend surface at two positions separated in the width direction.

9. A combination according to claim 5, wherein said second pressing portion is formed so as to make surface contact with said neighboring surface.

10. A combination according to claim 5, wherein said second pressing portion is formed so as to make contact with said neighboring surface at two positions separated in the direction of the progress of operation.

11. A combination according to claim 5, wherein said second pressing portion is formed so as to make contact with said neighboring surface at two positions separated in the width direction.

12. A combination according to claim 5, wherein said second pressing portion is an edge making line contact with said neighboring surface in parallel to the direction of the progress of operation.

13. A combination according to claim 5, wherein said second pressing portion is a plane making line contact with said neighboring surface in parallel to the direction of the progress of operation.

14. A combination according to claim 5, wherein said tape guide member further comprises a liner guide member for guiding a liner separated from said adhesive tape in another direction, and said tape position defining member of said tape guide member is disposed on a rear side of said pressing member in the direction of the progress of said pressing member.

15. A combination according to claim 14, wherein said tape position defining member is further comprised of a flange member having larger area than a cross section of said guide bar, and the position of said tape in the width direction being defined by said tape guide member attaching member and said flange member.

16. A combination according to claim 15, wherein said unapplied tape guide member is comprised of an unapplied tape guide block attached to said tape guide member attaching member.

17. A combination according to claim 14, wherein said liner guide member is comprised of a liner guiding block attached to said rear side of said pressing member.

18. A combination according to claim 15, wherein said tape guide member attaching member also serves as a supporting member for said adhesive tape.

19. A combination according to claim 5, further including a holding member connected to said pressing member for supporting said pressing member in such a manner that an operator can move said pressing member with said first pressing portion pressing to said adherend surface and said second pressing portion pressing to said neighboring surface.

20. A combination according to claim 5, wherein said intermediate portion of said pressing member does not contact said adherend member when said first pressing portion is pressingly in contact with said adherend surface and said second pressing portion is in contact with said neighboring surface.

21. A combination according to claim 5, wherein said body part is an automobile body part.

* * * * *

UNITED STATES PATENT AND TRADEMARK OFFICE

CERTIFICATE OF CORRECTION

PATENT NO. : 7,273,528 B2
APPLICATION NO. : 10/474279
DATED : September 25, 2007
INVENTOR(S) : Masayuki Kubota It is certified that error appears in the above-identified patent and that said Letters Patent is hereby corrected as shown below:

Column 9 – Line 25 - Delete "a" and insert -- α --, therefor.

Signed and Sealed this

Thirtieth Day of September, 2008

JON W. DUDAS
*Director of the United States Patent and Trademark Office*